United States Patent [19]

Hardwick

[11] 4,034,934

[45] July 12, 1977

[54] FILAMENT WINDING MACHINES

[75] Inventor: John Gordon Hardwick, Kidderminster, England

[73] Assignee: Imperial Metal Industries (Kynock) Limited, Birmingham, England

[21] Appl. No.: 580,468

[22] Filed: May 22, 1975

[30] Foreign Application Priority Data

May 30, 1974 United Kingdom ..... 24052/74

[51] Int. Cl.[2] ..... B65H 57/28

[52] U.S. Cl. ..... 242/158 B; 74/37; 74/110; 74/89.2

[58] Field of Search ..... 74/37, 27, 89.2, 110; 242/158 B

[56] References Cited

U.S. PATENT DOCUMENTS

| | | | |
|---|---|---|---|
| 2,840,347 | 6/1958 | Feucht | 74/110 |
| 3,010,328 | 11/1961 | Forey | 74/110 |
| 3,146,962 | 9/1964 | Hardwick | 242/158 B |
| 3,273,408 | 9/1966 | Nagel et al. | 74/37 |
| 3,475,980 | 11/1969 | Kishimoto | 74/37 |
| 3,518,889 | 7/1970 | McClean | 74/37 |
| 3,544,019 | 12/1970 | Lapidas | 74/37 |
| 3,708,132 | 1/1972 | Lang | 242/158 B |

FOREIGN PATENT DOCUMENTS

| | | | |
|---|---|---|---|
| 909,480 | 12/1945 | France | 74/89.2 |
| 623,215 | 5/1949 | United Kingdom | 242/158 B |
| 1,205,771 | 9/1970 | United Kingdom | 242/158 B |
| 1,393,324 | 5/1975 | United Kingdom | 242/158 B |

*Primary Examiner*—C. J. Husar

*Attorney, Agent, or Firm*—Cushman, Darby & Cushman

[57] ABSTRACT

A drive for a filament guide wherein reciprocatory motion of a first member is transferred to the filament guide via a gear mechanism to give a predetermined amplification factor.

12 Claims, 7 Drawing Figures

FILAMENT WINDING MACHINES

BACKGROUND OF THE INVENTION

This invention relates to filament winding machines particularly, but not exclusively, intended for preparing structures such as pressure vessels, for example by the winding of filamentary reinforcement material onto a mandrel. The reinforcement material is normally embedded in a suitable matrix, and when the vessel is self-supporting, the mandrel is removed. Typical materials to be used with such a winding machine are glass or carbon fibre as the filamentary reinforcement material, and elastomeric or resin material for the matrix.

The invention is particularly concerned with a filament guide system for a filament winding machine.

Current filament winding machines are provided with a filament guide system which usually comprises a filament guide carriage arranged for rectilinear reciprocation along the machine parallel to the axis of the mandrel. The motion of the carriage is usually designed to be such that the filament is guided thereby onto the mandrel in a helical path along any cylindrical portion of the mandrel, and to follow an approximately geodetic path around each end of the mandrel. As the carriage reciprocates, the filament is laid onto the mandrel in a pattern which in due course provides even reinforcement over the mandrel surface in forming a strong body or the pressure vessel.

The carriage is provided with a drive mechanism to enable it to follow the required movements for the necessary pattern to be produced. The drive mechanism may comprise a yoke upon which the carriage is mounted, the yoke being linked to an endless chain traversing around a pair of rotating sprockets. The connection between the yoke and the chain is a guide pin which will move the yoke at a constant speed whilst on the horizontal flight between the two sprockets, and will then displace the yoke with simple harmonic motion whilst passing along the semi-circular path around each sprocket; in this part of the movement, the pin slides along a vertical slot in the yoke. The path to be followed by the carriage is dictated by the pattern required on the mandrel, and particularly for large diameter and low winding angle mandrels, this means that the sprockets have to be correspondingly large.

It will also be appreciated that for the same shape but different sizes of mandrels, substantial adjustment of the winding machine is required in that different sprocket sizes will be necessary together with different lengths of chain.

It is an object of the invention to provide a more versatile filament guide system for a filament winding machine.

SUMMARY OF THE INVENTION

The present invention consists in a filament guide system for a filament winding machine which comprises:

a. drive mechanism including a pair of sprockets carrying an endless chain, and a yoke coupled to the chain for reciprocation upon rotation of the sprockets and traverse of the chain, b. a driven mechanism including a rectilinearly reciprocable filament guide carriage, and c. a gear mechanism linking the yoke of the drive mechanism and the carriage of the driven mechanism for synchronously transmitting the motion of the yoke to the carriage at different speeds.

Preferably the gear mechanism is provided by a selector gear box, but alternatively the gear mechanism may comprise two sprockets of different diameter fixed to rotate with one another, one sprocket being enmeshed by the endless chain of the drive mechanism, and the other sprocket being enmeshed by a driven chain for driving the filament guide carriage.

As a practical matter, it is impossible for the filamentary reinforcement material to be guided directly onto the mandrel, ie with direct contact of the guide head with the mandrel surface. Accordingly, it is conventional to arrange for the guide head to be advanced from the point of lay of the filament on the mandrel surface to a degree that is required for the filament to make contact at that point. Thus, preferably the filament guide system comprises an advance mechanism.

Preferably also the guide system comprises an advance mechanism which comprises a drive pair of double sprockets mounted on opposite ends of a tilt lever, pivoted on the yoke, a driven pair of double sprockets mounted on opposite ends of a tilt lever pivoted on the carriage, a first chain extending between one sprocket each of the upper drive and driven double sprockets, passing around those sprockets and then between and around one sprocket each of the lower drive and driven double sprockets, a second chain extending between the other sprocket each of the lower drive and driven double sprockets, passing around those sprockets and then between and around the other sprocket each of the drive and driven double sprockets, a tilt drive linkage on the yoke coupled to the yoke tilt lever, and a coupling between the tilt lever on the carriage and a filament guide head carried by the carriage whereby operation of the tilt drive linkage swings the yoke tilt lever, this is transmitted by the chains to the carriage tilt lever, so that the filament guide head is angled to provide the required advance.

BRIEF DESCRIPTION OF THE DRAWINGS

A typical example of the invention and modifications thereof will now be described with reference to the accompanying drawings in which.

DESCRIPTION OF THE PREFERRED EMBODIMENTS

Figure 1:
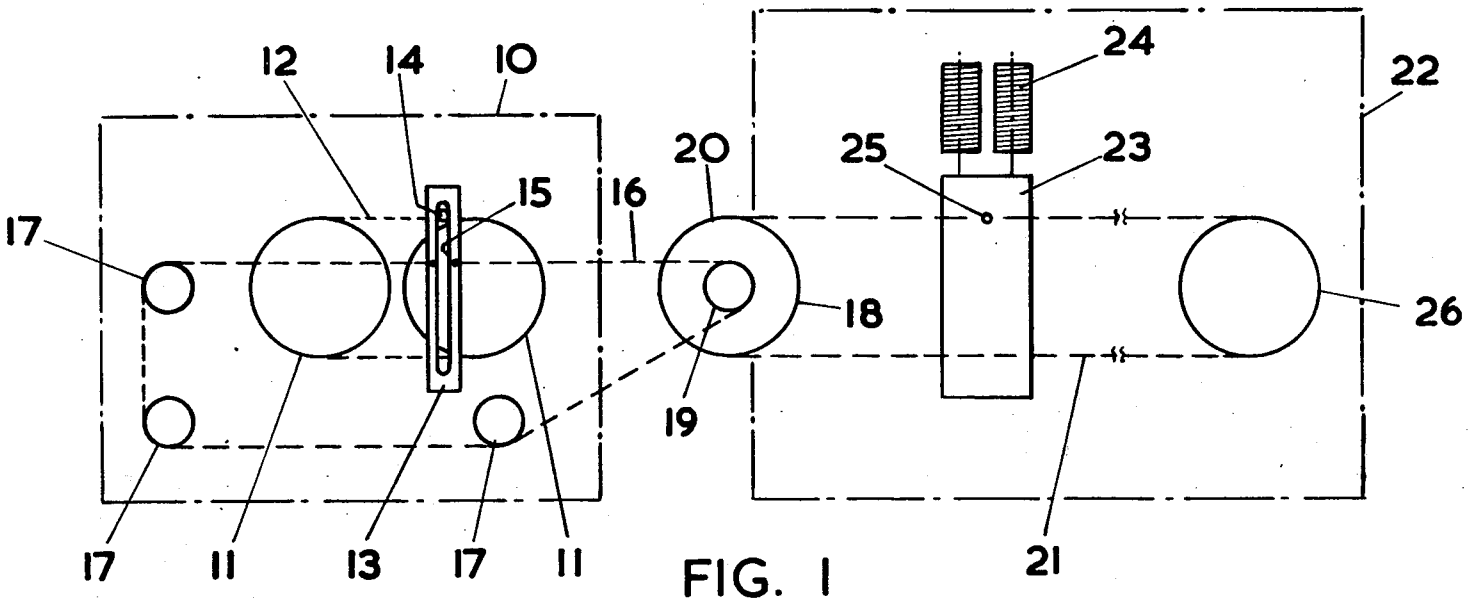
FIG. 1 is a diagrammatic view of the embodiment.

Referring initially to FIG. 1, this shows a drive mechanism 10 comprising a pair of matched sprockets 11 mounted for rotation about horizontal axes and lying in the same vertical plane. The sprockets are interconnected by an endless chain 12 running around their semi-circular peripheries opposed to one another, and the horizontal flights therebetween.

The drive mechanism 10 also comprises a yoke 13 arranged for horizontal reciprocation, and caused to reciprocate by the provision of a link pin 14. The pin 14 is affixed to the chain 12 and is slidable in a vertical guide slot 15 in the yoke 13.

The horizontal motion of the yoke 13 is transmitted to an endless chain 16 arranged around guide sprockets 17 and enmeshed with a gear mechanism 18.

The gear mechanism 18 comprises two sprockets of different diameter which are fixed together to rotate about the same horizontal axis at the same angular velocity. The smaller sprocket 19 is enmeshed by the endless chain 16. The larger sprocket 20 carries the endless chain 21 of a driven mechanism 22.

The driven mechanism 22 comprises a rectilinearly reciprocable filament guide carriage 23 which in this example carries spools 24 of the filamentary reinforcement material to be used in the winding machine and a guide comb for the filamentary material. If required, the spools 24 can be mounted at a fixed position and the filament simply carried through the guide comb on the carriage. The carriage 23 is secured to the endless chain 21 by a pin 25 in order to reciprocate therewith. The chain 21 also passes around a sprocket 26 arranged in relation to the chain 21 to keep the flight of the chain 21 carrying the pin 25 horizontal and taut.

In use, the sprockets 11 are turned at a constant speed in order to move the yoke 13 backwards and forwards in accordance with the movement of the pin 14 fixed to the chain 12. As the pin 14 moves along the horizontal flights between the sprockets 11, the yoke moves at a constant speed in the requisite direction. As the pin 14 moves around the semi-circular flights of the chain 12, the yoke is displaced with simple harmonic motion.

The displacement of the yoke 13 is transmitted by the chain 16 directly to the smaller sprocket 19 of the gear mechanism 18.

The gear mechanism 20 multiplies the movement of the chain 16 to produce movement of the chain 21 in accordance with the ratio between the diameters of the small sprocket 19 and the larger sprocket 20. Accordingly, the movement of the carriage 23 is magnified to that degree.

It will be appreciated that this drive mechanism can be used to wind mandrels of the same shape and winding angle but different sizes simply by altering the ratio of the diameters of the small and large sprockets 19,20 of the gear mechanism 18. If required, the gear mechanism can be inverted in order to reduce the movement of the carriage 23 by that ratio. To facilitate such adjustment, the gear mechanism 18 can be replaced by a selector gear box.

It will also be appreciated that there can be positioned along the endless chain 21 a plurality of carriages such as the carriage 23 to enable a plurality of mandrels to be wound with reinforcement material at the same time.

Figure 2:
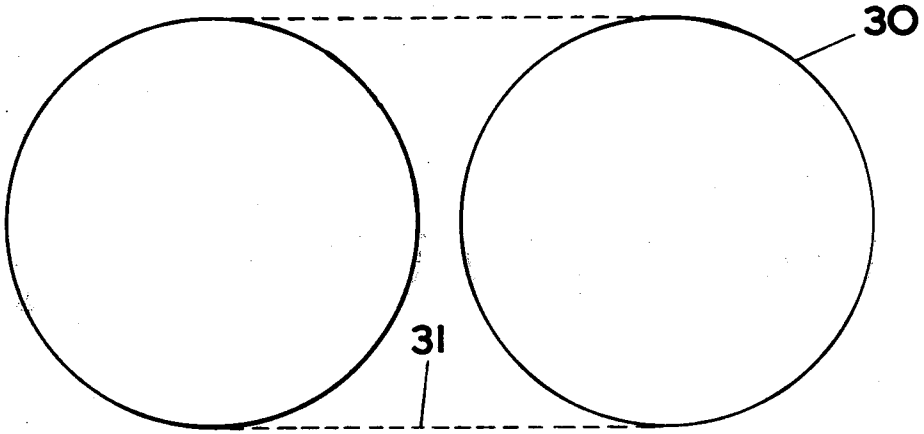
FIG. 2 shows the equivalent drive mechanism of the prior art.

Referring now to FIG. 2, this shows, approximately to the same scale as that of FIG. 1, the sprocket and chain assembly that would be necessary to produce the same carriage movement. Thus there are shown two sprockets 30 carrying an endless chain 31, each sprocket 30 having a diameter equal to the diameter of each sprocket 11 multiplied by the ratio of the diameters of the larger to the smaller of the gear sprockets 20 and 19.

Figure 3:
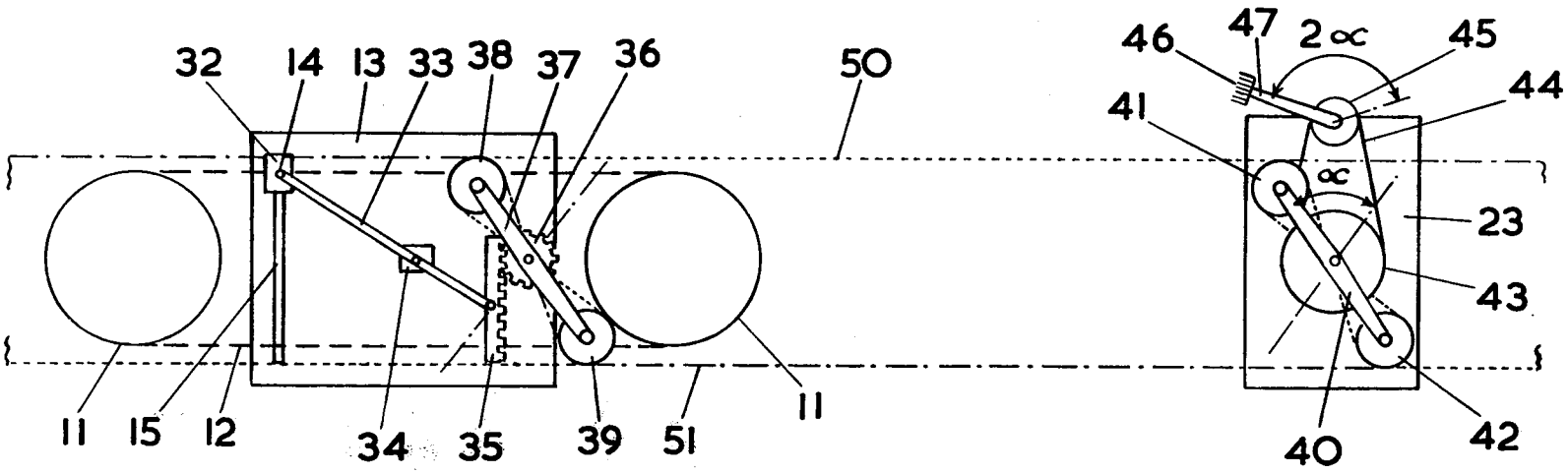
FIG. 3 is a diagrammatic detail view of the embodiment with an advance mechanism.

Referring now to FIG. 3 of the drawings, this shows an advance mechanism in which the pin 14 carries a slide block 32 which mounts one end of a lever 33 with a fulcrum at 34 and of which the other end carries a rack 35. The rack 35 is engaged with a pinion 36 mounted on the yoke 13 and carrying a drive tilt lever 37. The opposite ends of the tilt lever 37 carry upper and lower double sprockets 38 and 39, respectively.

It will be appreciated that upon rotation of the pair of sprockets 11 and traverse of the endless chain 12 therearound, engagement of the pin 14 in the slot 15 of the yoke 13 causes the yoke 13 to traverse from side to side, this traverse having a uniform speed as the pin 14 moves along horizontal flights of the chain 12, and causes one half of a cycle of simple harmonic motion as the pin 14 moves around the semi-circular flights of the chain 12 around each sprocket 11. During these simple harmonic motion periods, the pin 14 and the slide block 32 move along the length of the slot 15 in the yoke to transfer from one horizontal flight to the other horizontal flight. This vertical movement is transmitted by the lever 33 to the rack 35, and hence to the pinion 36. This drives the tilt lever 37 to displace it from the one position shown in FIG. 3 to another position opposite thereto and symmetrical about a vertical line through the centre of the pinion 36.

The driven mechanism comprises the rectilinearly reciprocable carriage 23 upon which is mounted a driven tilt lever 40 carrying upper and lower double sprockets 41 and 42, respectively, of the same dimensions as the drive tilt lever and sprockets already described. Affixed to the driven tilt lever 40 is a sprocket 43 for rotation therewith, the sprocket 43 being engaged by chain drive 44 with a sprocket 45 of about half the diameter of the sprocket 43. The sprocket 45 carries a filament guide head 46 on an arm 47.

The drive and driven mechanisms are interconnected by a number of lengths of chain. Thus there is provided an upper length of chain 50 which extends between the drive and driven mechanisms and passes around one sprocket each of the upper double sprockets 38 and 41, and then between the upper and lower double sprockets of each tilt mechanism, ie between the upper and lower double sprockets 38 and 39 and between the upper and lower double sprockets 41 and 42. The chain then passes around one each of the lower double sprockets 39,42 and extends from the tilt mechanisms in opposite directions. The flight of the chain is therefore S- or Z-shaped. The ends of the chain 50 are supported by means to be described.

There is also provided a lower chain 51 which extends horizontally between the other sprocket each of the lower double sprockets 39,42, passes around them and then between the upper and lower double sprockets 38,39 and 41,42 of the two tilt mechanisms. The chain 51 then extends around the other sprocket each of the upper double sprockets 38,41 and extends away from the tilt mechanisms in opposite directions. The flights of the chain 51 around the tilt mechanisms are therefore Z- or S-shaped and are opposite to those of the chain 50. The ends of the chain 51 are mounted in a similar way to those of the chain 50, and will be described below.

The drive afforded the carriage 23 by the yoke 13 is that described above in relation to FIG. 1, and it will be seen that the longitudinal displacements of the yoke 13 and the carriage 23 can take place without disturbing the positions of the chains 50 and 51. For example, as the yoke 13 moves from left to right as shown in FIG. 3, increasing lengths of the chain 50 are taken from its upper horizontal flight to pass around the double sprockets 39 and 38 to appear above and behind the yoke 13. The undeflected flights of the upper and lower chains 50 and 51 do not move. The same thing applies to the chains 50 and 51 in the vicinity of the carriage 23. Because the chains have no movement, there is no reason why the carriage should not move at a different speed from that of the yoke, and as mentioned above this is provided by the drive mechanism described in relation to FIG. 1. However, when the pin 14 moves along the semicircular flight around each sprocket 11, the tilt linkage swings the tilt lever 37 to its opposite position, and this displaces the chains 50,51 in opposite directions. This constitutes a tilt drive which affects the driven tilt mechanism of the carriage 23 in the same way, and thereby swings the driven tilt lever 40 to its opposite position. By the sprocket 43, chain 44 and sprocket 45, this tilt motion is transmitted and approximately doubled for the arm 37 in order to swing the filament guide head 46 from one extreme position to the other. In this way is reversed at the end of each reciprocation the advance given to the filament by the filament guide head 46.

Figure 4:
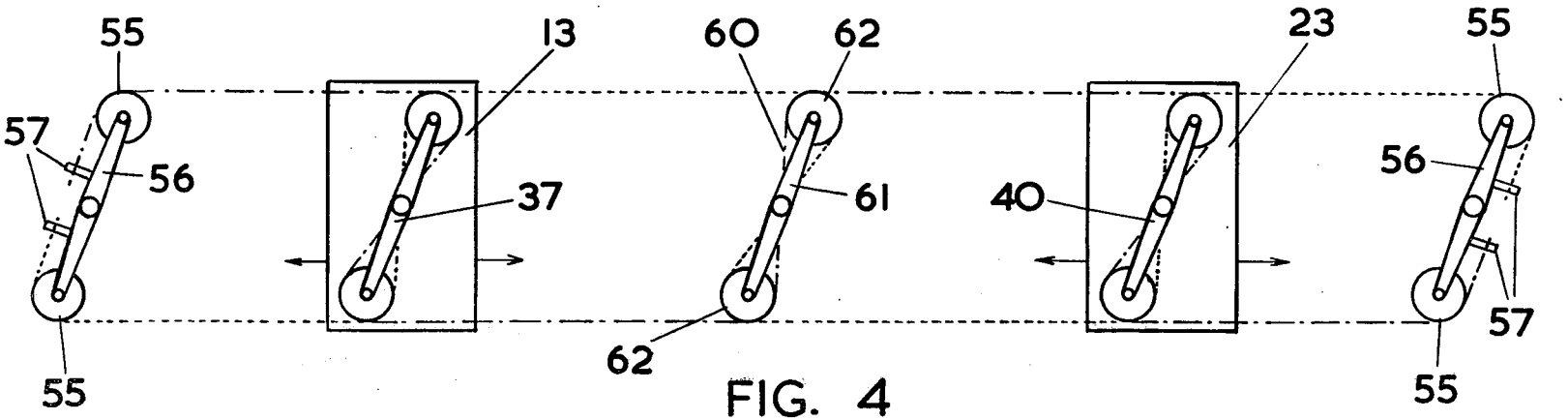
FIG. 4 is a diagrammatic view of the embodiment of FIG. 3 as adapted to large machines.

The support given to the ends of the chains 50,51 will now be described in detail in connection with FIG. 4 of the drawings in which in a simplified fashion, there are shown the yoke 13 with its tilt mechanism, the carriage 23 with its tilt mechanism. As can be seen from FIG. 4, the ends of the chains 50 and 51 at each end of the machine pass around single sprockets 55 mounted on a tilt lever 56 of the same length as the tilt levers 37 and 40. The chain ends are then fixed at 57 to the tilt levers 56. The swinging of the tilt lever 37 on the yoke 13 therefore effects the swinging of the tilt lever 40 on the carriage 23 and also the tilt levers 56 at the ends of the chains. If required, particularly when long lengths of chain are required, the flights of the chains 50,51 between the yoke 13 and the carriage 23 can be supported by the use of double sprocket idlers 60 which comprise the same arrangement of a tilt lever 61 and a pair of double sprockets 62. The double sprocket idlers 60 simply transmit the same tilting motion that they receive.

It wll also be appreciated that the carriage 23 can be supplemented by further carriages of which the same motion is required, these being interposed at the requisite spacings between the yoke 13 and the ends of the chains 50,51.

Figure 5:
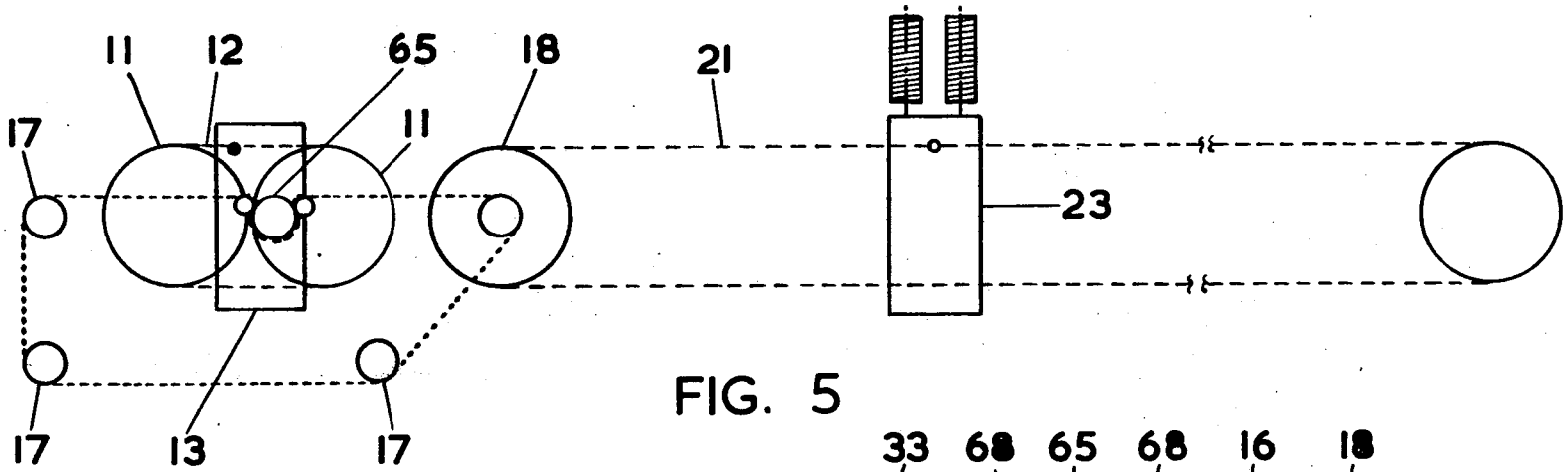
FIG. 5 is a diagrammatic view of the embodiment with a modified advance mechanism.
Figure 6:
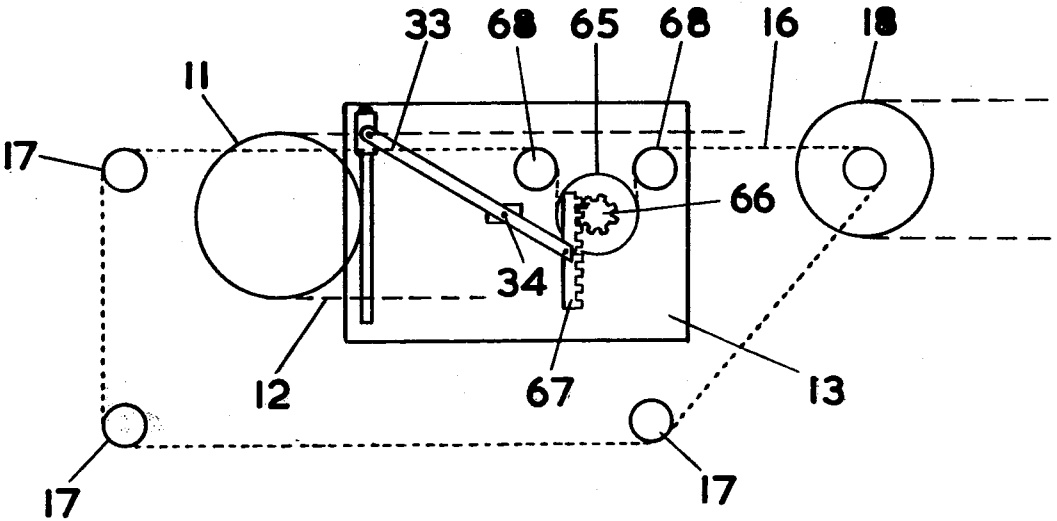
FIG. 6 is a diagrammatic view on an enlarged scale of part of the drive mechanism of FIG. 5.
Figure 7:
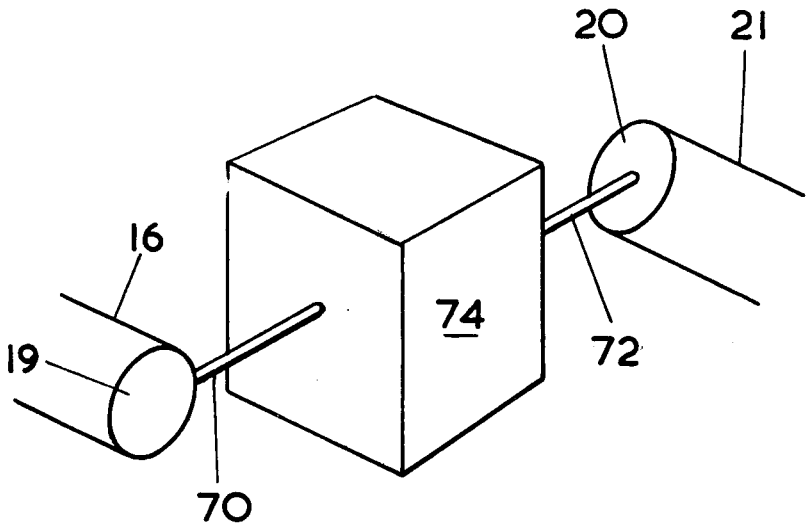
FIG. 7 is a diagrammatic view of another embodiment.

Referring now to FIGS. 5 and 6, these show a modified advance mechanism comprising an additional drive sprocket 65 mounted on the yoke 13 at a fixed position, and carrying part of the flight of the drive chain 16. The sprocket 65 is fixed to a pinion 66 for rotation therewith, and the pinion 66 is engaged by a rack 67 similar to the rack 35 described in relation to FIG. 3. During normal reciprocation of the yoke 13 with the pin 14 passing along the horizontal flights of the chain 12, the lever 33 is fixed in position and so therefore is the rack 67, the pinion 66 and the sprocket 65. Accordingly, the chain 16 is moved in concordance with the displacement of the yoke 13. However, when the pin 14 passes around the semi-circular flights of the chain 12 around each sprocket 11, this causes the lever 33 to rotate, and therefore the rack 67 to be displaced and to turn the pinion 66 and hence the sprocket 65. This causes additional displacement of the chain 16 over and above the displacement caused by movement of the yoke 13. As can be seen from FIG. 6, idler sprockets 68 may be provided if required to help support the chain 16. In this way additional movement is given to the chain 16 and hence through the gear mechanism 18 to the carriage 23 in order to advance the carriage from the point of lay of the filamentary reinforcement upon the mandrel. At the end of each reciprocation of the yoke 13, the advance movement applied during that reciprocation is cancelled and advance is then applied to the yoke ready for the next reciprocation. The degree of advance is readily adjusted by adjustment of the position of the fulcrum 34 for the lever 33.

In the event that advance of the filament guide head should be required simply on the basis of additional movement of the rectilinearly reciprocable carriage 23, this can be provided by the use of an additional drive sprocket 65 arranged in the drive chain.

I claim:

1. In or for a filament winding machine, a filament guide system comprising: a guide carriage, a drive for said carriage comprising an endless member passing around rotary supports and linked to the carriage to reciprocate the latter, a reciprocable member, drive means for reciprocating said member, and a gear transmission linking the reciprocable member and said drive so that reciprocation of said member is transferred to the carriage with a predetermined amplification factor.

2. A system as claimed in claim 1 wherein the reciprocable member can be reciprocated by means of an endless chain and sprocket drive.

3. A system as in claim 1 wherein said gear transmission has a rotary input, there being means for converting reciprocating motion of the reciprocable member into rotary motion for input to said transmission.

4. A system as in claim 1 wherein said factor is variable.

5. A filament guide system for a filament winding machine which comprises:

a. a drive mechanism including a pair of sprockets carrying an endless chain, and a yoke coupled to the chain for reciprocation upon rotation of the sprockets and traverse of the chain, b. a driven mechanism including a rectilinearly reciprocable filament guide carriage, and c. a gear mechanism linking the yoke of the drive mechanism and the carriage of the driven mechanism for synchronously transmitting the motion of the yoke to the carriage at different speeds.

6. A system as claimed in claim 5 wherein the gear mechanism comprises a selector gear box.

7. A system as claimed in claim 5 wherein the drive mechanism comprises an endless member passing around rotary supports and linked to the carriage to reciprocate the latter.

8. A system as claimed in claim 1 wherein the gear mechanism comprises two sprockets of different diameter fixed to rotate with one another, one sprocket being enmeshed by the endless chain of the drive mechanism, and the other sprocket being enmeshed by a driven chain for driving the filament guide carriage.

9. A system as in claim 5 including an advance mechanism for advancing the filament guide relative to the carriage.

10. A system as claimed in claim 9 wherein the advance mechanism is operable to reverse the advance upon reverse of the carriage in response to a change in movement of the yoke to bring about said reverse of the carriage.

11. A system as claimed in claim 10 wherein a tilt lever is arranged to be tilted upon said change in movement, and a linkage is provided to transfer tilting of the lever to said advance mechanism to reverse it.

12. A system as claimed in claim 9 wherein the advance mechanism comprises a drive pair of double sprockets mounted on opposite ends of a tilt lever, pivoted on the yoke, a driven pair of double sprockets mounted on opposite ends of a tilt lever pivoted on the carriage, a first chain extending between one sprocket each of the upper drive and driven double sprockets, passing around those sprockets and then between and around one sprocket each of the lower drive and driven double sprockets, a second chain extending between the other sprocket each of the lower drive and driven double sprockets, passing around those sprockets and then between and around the other sprocket each of the drive and driven double sprockets, a tilt drive linkage on the yoke coupled to the yoke tilt lever, and a coupling between the tilt lever on the carriage and a filament guide head carried by the carriage whereby operation of the tilt drive linkage swings the yoke tilt lever, this is transmitted by the chains to the carriage tilt lever, so that the filament guide head is angled to provide the required advance.

* * * * *